US009943166B1

(12) United States Patent
Cleary

(10) Patent No.: US 9,943,166 B1
(45) Date of Patent: Apr. 17, 2018

(54) COLLAPSIBLE SHELF ASSEMBLY

(71) Applicant: Wendy Cleary, Elma, NY (US)

(72) Inventor: Wendy Cleary, Elma, NY (US)

( * ) Notice: Subject to any disclaimer, the term of this patent is extended or adjusted under 35 U.S.C. 154(b) by 0 days.

(21) Appl. No.: 15/413,609

(22) Filed: Jan. 24, 2017

(51) Int. Cl.
*A47B 43/00* (2006.01)
*A47B 61/04* (2006.01)
*A47B 47/00* (2006.01)

(52) U.S. Cl.
CPC ..... *A47B 43/00* (2013.01); *A47B 47/0075* (2013.01); *A47B 61/04* (2013.01)

(58) Field of Classification Search
CPC ..... A47B 43/00; A47B 43/04; A47B 61/04; A47B 47/0075; A47F 5/10; A47F 5/101
See application file for complete search history.

(56) References Cited

U.S. PATENT DOCUMENTS 1,216,250 A * 2/1917 Bittle ..... A47B 43/04 211/10
1,847,066 A 3/1932 Berg
2,389,910 A 11/1945 Hoffman
2,845,185 A 7/1958 Winderweedle, Jr.
2,943,899 A 7/1960 Beller
3,669,276 A 6/1972 Woods
4,214,669 A * 7/1980 McQuiston ..... B65D 88/524 220/1.5
4,577,772 A * 3/1986 Bigliardi ..... B65D 88/121 220/1.5
4,579,401 A * 4/1986 Mears ..... A47B 43/00 312/258
4,630,746 A * 12/1986 Fortenberry ..... B65D 19/18 220/1.5
4,848,618 A * 7/1989 Yuan ..... B65D 88/524 220/1.5
4,867,513 A * 9/1989 Choi ..... F16B 12/26 312/108
5,038,953 A * 8/1991 Radar ..... B65D 11/1826 220/6
5,107,639 A * 4/1992 Morin ..... E04B 1/3445 220/6
5,253,763 A * 10/1993 Kirkley ..... B65D 19/16 206/600
5,382,087 A * 1/1995 Pouch ..... A47B 43/00 160/135
D417,556 S 12/1999 Schell
7,063,397 B2 6/2006 Sabounjian
8,342,347 B2 * 1/2013 Hay ..... B65D 11/1866 16/352
8,376,477 B2 * 2/2013 Schinzing ..... A47B 45/00 312/205
8,657,124 B2 2/2014 Brown
(Continued)

FOREIGN PATENT DOCUMENTS

DE 102004041625 A1 * 4/2006 ..... A47B 43/00
WO WO2014184413 11/2014

*Primary Examiner* — Stanton L Krycinski

(57) ABSTRACT

A collapsible shelf assembly includes a plurality of uprights. Each of the uprights is selectively positioned between a collapsed position and an extended position. A plurality of shelves is provided and each of the shelves is slidably coupled between an associated pair of the uprights. Each of the shelves may support an object. Each of the uprights is selectively positioned between a maximum distance apart from each other and a minimum distance apart from each other.

7 Claims, 4 Drawing Sheets

(56) References Cited

U.S. PATENT DOCUMENTS

| | | | | |
|---|---|---|---|---|
| 9,198,508 | B1 * | 12/2015 | Kufel | A47F 5/116 |
| 2005/0252869 | A1 * | 11/2005 | Graham | A47B 61/04 211/36 |
| 2006/0175945 | A1 * | 8/2006 | Deguchi | A47B 88/417 312/257.1 |
| 2007/0090062 | A1 * | 4/2007 | Girault | A45C 3/12 211/36 |
| 2009/0014445 | A1 * | 1/2009 | Hay | B65D 19/18 220/6 |
| 2010/0276241 | A1 * | 11/2010 | Malone | A45C 5/03 190/9 |
| 2011/0084069 | A1 * | 4/2011 | Hay | B65D 11/1866 220/4.28 |
| 2014/0209493 | A1 | 7/2014 | Hale et al. | |
| 2014/0246426 | A1 * | 9/2014 | Sabounjian | A47B 43/003 220/9.2 |
| 2015/0041420 | A1 * | 2/2015 | Zelek | A47B 43/00 211/149 |

* cited by examiner

COLLAPSIBLE SHELF ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shelf devices and more particularly pertains to a new shelf device for storing and organizing objects.

BRIEF SUMMARY OF THE INVENTION

An embodiment of the disclosure meets the needs presented above by generally comprising a plurality of uprights. Each of the uprights is selectively positioned between a collapsed position and an extended position. A plurality of shelves is provided and each of the shelves is slidably coupled between an associated pair of the uprights. Each of the shelves may support an object. Each of the uprights is selectively positioned between a maximum distance apart from each other and a minimum distance apart from each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
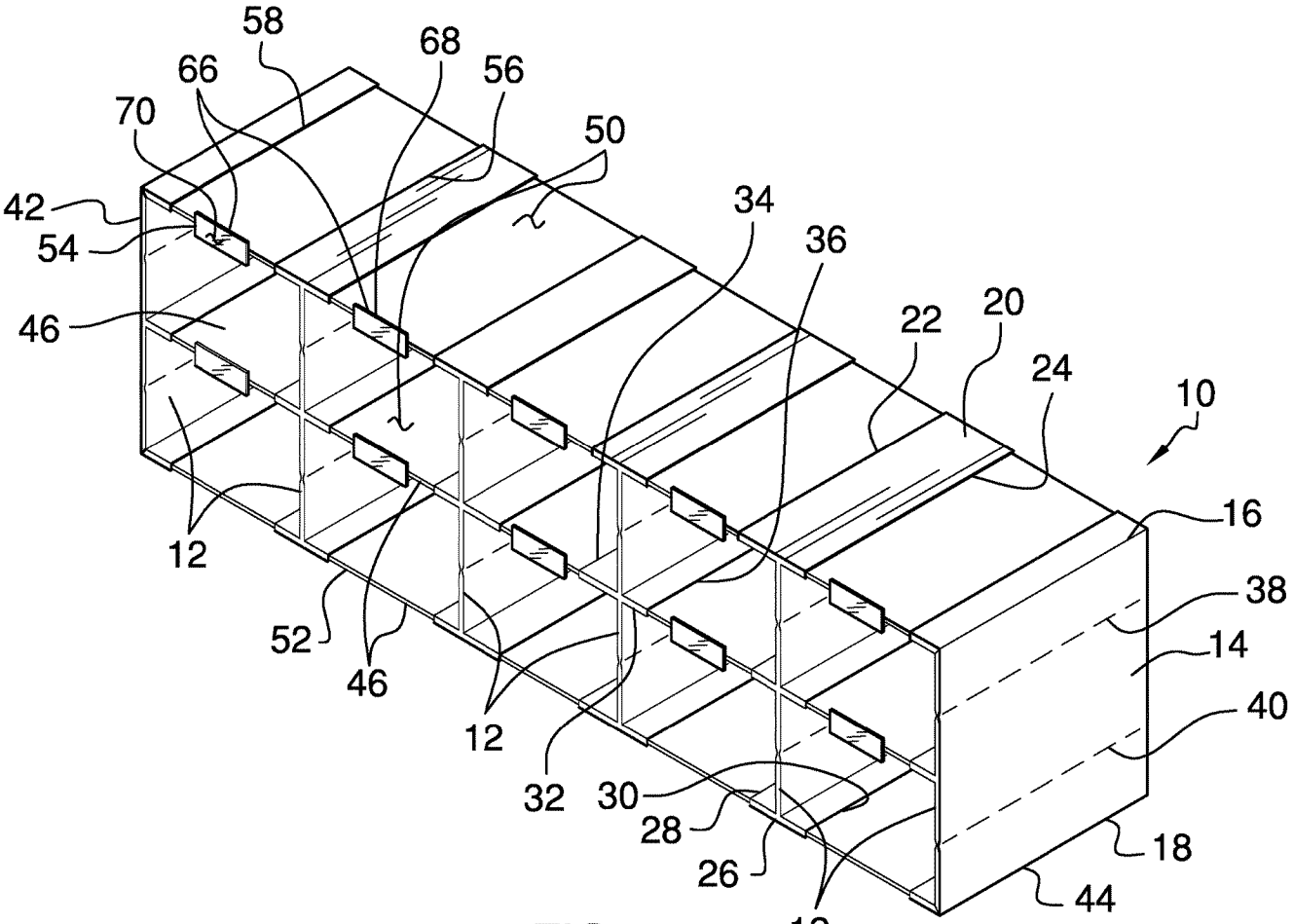
FIG. 1 is a front perspective view of a collapsible shelf assembly according to an embodiment of the disclosure.
Figure 2:
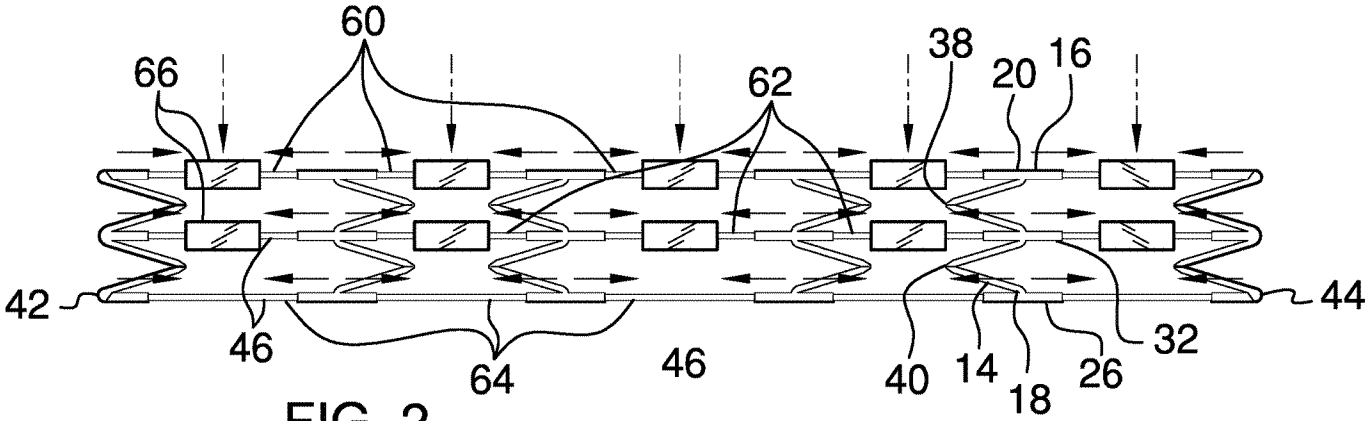
FIG. 2 is a front view of an embodiment of the disclosure in a collapsed position.
Figure 3:
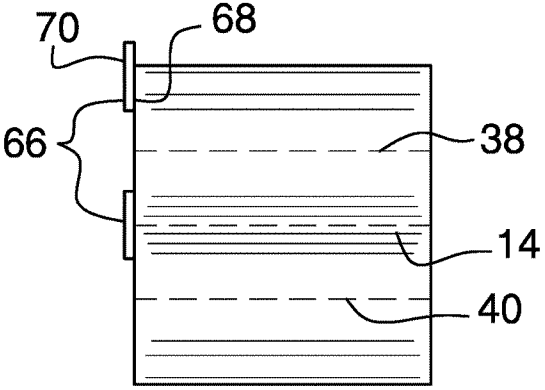
FIG. 3 is a left side view of an embodiment of the disclosure.
Figure 4:
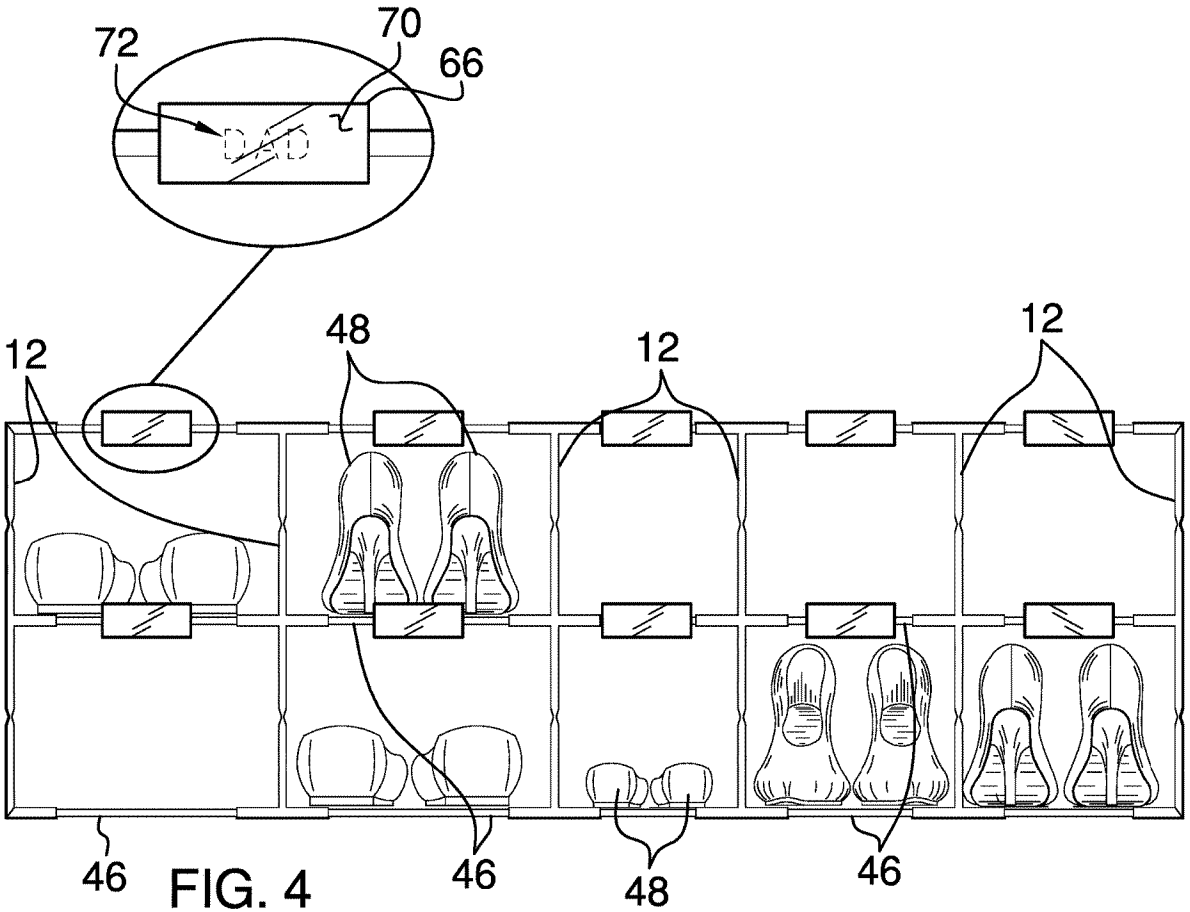
FIG. 4 is a perspective in-use view of an embodiment of the disclosure.

With reference now to the drawings, and in particular to FIGS. 1 through 5 thereof, a new shelf device embodying the principles and concepts of an embodiment of the disclosure and generally designated by the reference numeral 10 will be described.

As best illustrated in FIGS. 1 through 5, the collapsible shelf assembly 10 generally comprises a plurality of uprights 12. Each of the uprights 12 is selectively positioned between a collapsed position and an extended position. Each of the uprights 12 comprises a panel 14 that has an upper edge 16 and a lower edge 18. A top receiver 20 is coupled to the upper edge 16 and the top receiver 20 has a first end 22 and a second end 24. Each of the first end 22 and the second end 24 is open. The top receiver 20 is oriented transverse with respect to the panel 14 having each of the first end 22 and the second end 24 extending away from the upper edge 16.

A bottom receiver 26 is coupled to the lower edge 18 and the bottom receiver 26 has a primary end 28 and a secondary end 30. Each of the primary end 28 and the secondary end 30 is open. The bottom receiver 26 is oriented transverse with respect to the panel 14 having each of the primary end 28 and the secondary end 30 extending away from the panel 14.

A middle receiver 32 is coupled to the panel 14 and the middle receiver 32 is centrally positioned between the top receiver 20 and the bottom receiver 26. The middle receiver 32 has a leading end 34 and a following end 36. Each of the leading end 34 and the following end 36 is open. The leading end 34 is aligned with the first end 22 and the primary end 28 and the following end 36 is aligned with the second end 24 and the secondary end 30.

The panel 14 corresponding to each of the uprights 12 has a first fold 38 that is positioned between the top receiver 20 and the middle receiver 32. The first fold 38 is coextensive with the first 20 and middle 32 receivers. The panel 14 corresponding to each of the uprights 12 has a second fold 40 that is positioned between the bottom receiver 26 and the middle receiver 32. The second fold 40 is coextensive with the middle 32 and bottom 26 receivers. The plurality of uprights 12 includes a first end upright 42 and a second end upright 44. The first end upright 42 does not have a first end 22, a leading end 34 and a primary end 28. The second end upright 44 does not have a second end 24, a following end 36 and a secondary end 30.

A plurality of shelves 46 is provided and each of the shelves 46 is slidably coupled between an associated pair of the uprights 12. In this way each of the shelves 46 may an object 48 which may be shoes, articles of clothing or any other object 48 having a weight being less than 500 grams. Each of the uprights 12 is selectively positioned between a maximum distance apart from each other and a minimum distance apart from each other. The maximum distance may range between approximately 80.0 cm and 90.0 cm. The minimum distance may range between approximately 50.0 cm and 60.0 cm.

Each of the shelves 46 has a first surface 50 and a perimeter edge 52 and the object 48 is placed on the first surface 50. The perimeter edge 52 has a front side 54, a first lateral side 56 and a second lateral side 58. The plurality of shelves 46 includes a set of top shelves 60, a set of middle shelves 62 and a set of bottom shelves 64. Each of the first end 22 and the second end 24 of an associated pair of the uprights 12 insertably receives an associated one of the first lateral side 56 and the second lateral side 58 of the top shelves 60. In this way each of said top shelves 60 is slidably positioned between the associated pair of uprights 12.

Each of the leading end 34 and the following end 36 of an associated pair of uprights 12 insertably receives an associated one of the first lateral side 56 and the second lateral side 58 of the middle shelves 62. In this way each of the middle shelves 62 is slidably positioned between the associated pair of uprights 12. Each of primary end 28 and the secondary end 30 of an associated pair of the uprights 12 insertably receives an associated one of the first lateral side 56 and the second lateral side 58 of the bottom shelves 64. In this way each of the bottom shelves 64 is slidably positioned between the associated pair of uprights 12.

Figure 5:
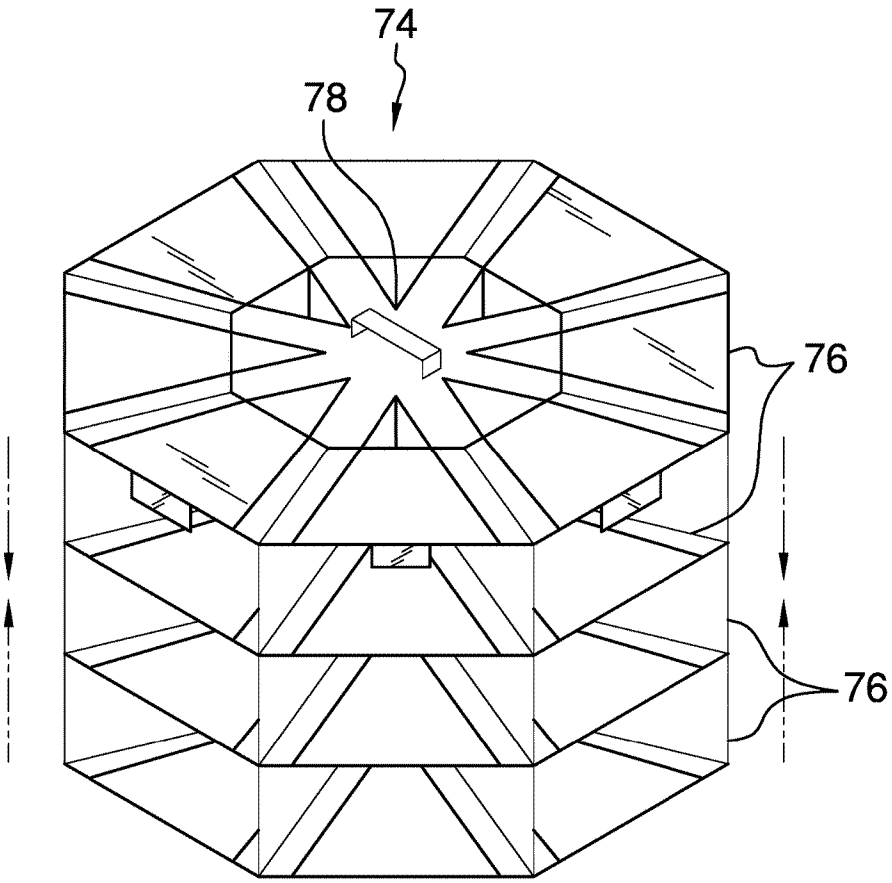
FIG. 5 is a perspective view of an alternative embodiment of the disclosure.

A plurality of plates 66 is provided and each of the plates 66 has a first surface 68 and a second surface 70. The first surface 68 corresponding to each of the plates 66 is coupled to the front side 54 of an associated one of the shelves 46. The second surface 70 corresponding to each of the plates 66 has indicia 72 printed thereon for identifying the plates 66. The indicia 72 may be an owner's name with respect to the object 48 placed on the corresponding shelves 46. In an alternative embodiment 74 as shown in FIG. 5, a plurality of disks 76 may be provided. Each of the disks 76 may be spaced apart from each other along a central hub 78. In this way each of the disks 76 may support the objects 48.

In use, the panel 14 is selectively unfolded having the top receiver 20 being spaced from the middle receiver 32 and having the bottom receiver 26 being spaced from the middle receiver 32. In this way the top shelves 60 are spaced from the middle shelves 62 and the bottom shelves 64 are spaced from the middle shelves 62. The objects 48 are placed on selected ones of the shelves 46 and corresponding indicia 72 is written on the plate 66. The objects 48 are removed from each of the shelves 46 to and the panel 14 is selectively folded along each of the first 38 and second 40 folds. In this way the top receiver 20 abuts the middle receiver 32 and the bottom receiver 26 abuts the middle receiver 32. Thus, the uprights 12 and the shelves 46 are collapsed for storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible shelf assembly being configured to contain and organize a plurality of objects, said assembly comprising:

a plurality of uprights, each of said uprights being selectively positioned between a collapsed position and an extended position, each of said uprights having a first end, a second end, a leading end, a following end, a primary end and a secondary end;

a plurality of shelves, each of said shelves being slidably coupled between an associated pair of said uprights wherein each of said shelves is configured to support an object, each of said uprights being selectively positioned between a maximum distance apart from each other and a minimum distance apart from each other, each of said shelves having a first surface and a perimeter edge, said perimeter edge having a front side, a first lateral side and a second lateral side, said plurality of shelves including a set of top shelves, a set of middle shelves and a set of bottom shelves; and each of said first end and said second end of an associated pair of said uprights insertably receiving an associated one of said first lateral side and said second lateral side of said top shelves, each of said leading end and said following end of an associated pair of uprights insertably receiving an associated one of said first lateral side and said second lateral side of said middle shelves, each of said primary end and said secondary end of an associated pair of said uprights insertably receiving an associated one of said first lateral side and said second lateral side of said bottom shelves.

2. The assembly according to claim 1, wherein each of said uprights comprises a panel having an upper edge and a lower edge.

3. The assembly according to claim 2, further comprising:

a top receiver;

a middle receiver;

a bottom receiver; and said panel having a first fold being positioned between said top receiver and said middle receiver, said first fold being coextensive with said first and middle receivers.

4. The assembly according to claim 3, wherein said panel has a second fold being positioned between said bottom receiver and said middle receiver, said second fold being coextensive with said middle and bottom receivers.

5. The assembly according to claim 4, wherein said panel is selectively folded along each of said first and second folds having said top receiver abutting said middle receiver and having said bottom receiver abutting said middle receiver, said panel being selectively unfolded having said top receiver being spaced from said middle receiver and having said bottom receiver being spaced from said middle receiver.

6. The assembly according to claim 1, further comprising a plurality of plates, each of said plates having a first surface and a second surface, said first surface corresponding to each of said plates being coupled to said front side of an associated one of said shelves, said second surface corresponding to each of said plates having indicia printed thereon.

7. A collapsible shelf assembly being configured to contain and organize a plurality of objects, said assembly comprising:

a plurality of uprights, each of said uprights being selectively positioned between a collapsed position and an extended position, each of said uprights comprising:

a panel having an upper edge and a lower edge, a top receiver being coupled to said upper edge, said top receiver having a first end and a second end, each of said first end and said second end being open, said top receiver being oriented transverse with respect to said panel having each of said first end and said second end extending away from said upper edge, a bottom receiver being coupled to said lower edge, said bottom receiver having a primary end and a secondary end, each of said primary end and said secondary end being open, said bottom receiver being oriented transverse with respect to said panel having each of said primary end and said secondary end extending away from said panel, a middle receiver being coupled to said panel, said middle receiver being centrally positioned between said top receiver and said bottom receiver, said middle receiver having a leading end and a following end, each of said leading end and said following end being open, said leading end being aligned with said first end and said primary end, said following end being aligned with said second end and said secondary end, said panel having a first fold being positioned between said top receiver and said middle receiver, said first fold being coextensive with said first and middle receivers, and said panel having a second fold being positioned between said bottom receiver and said middle receiver, said second fold being coextensive with said middle and bottom receivers, said panel being selectively folded along each of said first and second folds having said top receiver abutting said middle receiver and having said bottom receiver abutting said middle receiver, said panel being selectively unfolded having said top receiver being spaced from said middle receiver and having said bottom receiver being spaced from said middle receiver;

a plurality of shelves, each of said shelves being slidably coupled between an associated pair of said uprights wherein each of said shelves is configured to support an object, each of said uprights being selectively positioned between a maximum distance apart from each other and a minimum distance apart from each other, each of said shelves having a first surface and a perimeter edge, said perimeter edge having a front side, a first lateral side and a second lateral side, said plurality of shelves including a set of top shelves, a set of middle shelves and a set of bottom shelves, each of said first end and said second end of an associated pair of said uprights insertably receiving an associated one of said first lateral side and said second lateral side of said top shelves, each of said leading end and said following end of an associated pair of uprights insertably receiving an associated one of said first lateral side and said second lateral side of said middle shelves, each of primary end and said secondary end of an associated pair of said uprights insertably receiving an associated one of said first lateral side and said second lateral side of said bottom shelves; and a plurality of plates, each of said plates having a first surface and a second surface, said first surface corresponding to each of said plates being coupled to said front side of an associated one of said shelves, said second surface corresponding to each of said plates having indicia printed thereon for identifying said plates.

* * * * *